US008082990B2

(12) United States Patent
Lovell et al.

(10) Patent No.: US 8,082,990 B2
(45) Date of Patent: Dec. 27, 2011

(54) METHOD AND SYSTEM FOR PLACING SENSOR ARRAYS AND CONTROL ASSEMBLIES IN A COMPLETION

(75) Inventors: John R. Lovell, Houston, TX (US); Gabriel E. Tirado, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 293 days.

(21) Appl. No.: 12/424,252

(22) Filed: Apr. 15, 2009

(65) Prior Publication Data

US 2010/0101786 A1 Apr. 29, 2010

Related U.S. Application Data

(63) Continuation-in-part of application No. 12/101,198, filed on Apr. 11, 2008, now Pat. No. 7,896,070, and a continuation-in-part of application No. 11/688,089, filed on Mar. 19, 2007, now Pat. No. 7,735,555.

(60) Provisional application No. 61/045,872, filed on Apr. 17, 2008.

(51) Int. Cl.
*E21B 43/08* (2006.01)
*E21B 47/12* (2006.01)

(52) U.S. Cl. ..... 166/250.01; 166/66; 166/242.6

(58) Field of Classification Search ..... 166/250.01, 166/242.6, 66, 65.1, 386
See application file for complete search history.

(56) References Cited

U.S. PATENT DOCUMENTS

| | | | | |
|---|---|---|---|---|
| 4,852,648 | A * | 8/1989 | Akkerman et al. | 166/66.4 |
| 6,209,648 | B1 * | 4/2001 | Ohmer et al. | 166/313 |
| 6,286,595 | B1 * | 9/2001 | Oxnevad et al. | 166/242.7 |
| 6,419,022 | B1 * | 7/2002 | Jernigan et al. | 166/336 |
| 6,837,310 | B2 | 1/2005 | Martin | |
| 6,845,819 | B2 | 1/2005 | Barrett et al. | |
| 6,848,510 | B2 | 2/2005 | Bixenman et al. | |
| 6,863,129 | B2 | 3/2005 | Ohmer et al. | |
| 6,864,801 | B2 | 3/2005 | Tabanou et al. | |
| 6,866,306 | B2 | 3/2005 | Boyle et al. | |
| 6,896,074 | B2 | 5/2005 | Cook et al. | |
| 6,903,660 | B2 | 6/2005 | Clark et al. | |
| 6,911,418 | B2 | 6/2005 | Frenier | |
| 6,978,833 | B2 | 12/2005 | Salamitou et al. | |
| 7,000,697 | B2 | 2/2006 | Goode et al. | |
| 7,004,252 | B2 | 2/2006 | Vise et al. | |
| 7,007,756 | B2 | 3/2006 | Lerche et al. | |
| 7,040,402 | B2 | 5/2006 | Vercaemer | |
| 7,096,961 | B2 | 8/2006 | Clark et al. | |
| 7,147,060 | B2 | 12/2006 | Huber et al. | |
| 7,168,510 | B2 | 1/2007 | Boyle et al. | |

(Continued)

FOREIGN PATENT DOCUMENTS

EP 1570151 B1 7/2007

*Primary Examiner* — Kenneth L Thompson
(74) *Attorney, Agent, or Firm* — Brandon S. Clark; Rodney V. Warfford; Bob VanSommern

(57) ABSTRACT

A technique facilitates recovery of hydrocarbons in subterranean formations by simplifying the joining of completion assemblies downhole. The system and methodology utilize a well completion having completion assemblies that may be selectively engaged downhole without requiring precise positional accuracy for each signal communication line. A signal communication system is provided to facilitate engagement of the completion assemblies while enabling the transfer of various signals across the connection.

21 Claims, 3 Drawing Sheets

U.S. PATENT DOCUMENTS

| | | | |
|---|---|---|---|
| 7,178,608 | B2 | 2/2007 | Mayes et al. |
| 7,192,908 | B2 | 3/2007 | Frenier et al. |
| 7,243,715 | B2 | 7/2007 | Wang et al. |
| 7,258,164 | B2 | 8/2007 | Rezgui et al. |
| 7,445,042 | B2 | 11/2008 | Freer et al. |
| 2005/0083064 | A1 | 4/2005 | Homan et al. |
| 2005/0092488 | A1 | 5/2005 | Rodet et al. |
| 2005/0178554 | A1 | 8/2005 | Hromas et al. |
| 2006/0000604 | A1 | 1/2006 | Jenkins et al. |
| 2006/0090892 | A1 | 5/2006 | Wetzel et al. |
| 2006/0090893 | A1 | 5/2006 | Sheffield |
| 2006/0124297 | A1 | 6/2006 | Ohmer |
| 2006/0124318 | A1 | 6/2006 | Sheffield |
| 2006/0225926 | A1 | 10/2006 | Madhavan et al. |
| 2006/0254767 | A1 | 11/2006 | Pabon et al. |
| 2006/0283606 | A1 | 12/2006 | Partouche et al. |
| 2007/0044964 | A1 | 3/2007 | Grigar et al. |
| 2007/0107907 | A1 | 5/2007 | Smedstad et al. |
| 2007/0227727 | A1 | 10/2007 | Patel et al. |
| 2008/0041575 | A1 | 2/2008 | Clark et al. |
| 2008/0223585 | A1 | 9/2008 | Patel et al. |
| 2008/0236837 | A1 | 10/2008 | Lovell et al. |
| 2009/0025923 | A1 | 1/2009 | Patel et al. |
| 2009/0056947 | A1 | 3/2009 | Du et al. |

* cited by examiner

METHOD AND SYSTEM FOR PLACING SENSOR ARRAYS AND CONTROL ASSEMBLIES IN A COMPLETION

CROSS-REFERENCE TO RELATED APPLICATION

The present document is based on and claims priority to U.S. Provisional Application Ser. No. 61/045,872, filed Apr. 17, 2008; the present document also claims benefit as a continuation-in-part of co-pending U.S. application Ser. No. 11/688,089, filed Mar. 19, 2007, to Patel et al., titled "Method for Placing Sensor Arrays in the Sand Face Completion," and as a continuation-in-part of co-pending U.S. application Ser. No. 12/101,198, filed Apr. 11, 2008, to John Lovell, titled "Spoolable Sensors and Flow Isolation," The contents of each of the listed applications are herein incorporated by reference.

BACKGROUND

In a hydrocarbon producing well, there may be an upper completion and a lower completion. Landing or otherwise joining the upper completion to the lower completion presents challenges due, in part, to the inaccessibility of the joint. The joining of components often may require rotational accuracy and/or axial accuracy to ensure alignment and proper connection. In some applications, components such as wet-mate connectors may require both rotational and axial accuracy. However, the need to provide accuracy and mechanical precision with respect to components located downhole, increases the difficulty and cost of connecting upper completions to lower completions.

SUMMARY

In general, the present invention provides a system and methodology to facilitate the recovery of hydrocarbons in subterranean formations. The system and methodology utilize a well completion having a first completion assembly and a second completion assembly that may be selectively engaged downhole. Additionally, a signal communication system is provided to facilitate engagement of the first and second completion assemblies while enabling the transfer of various signals across the connection.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
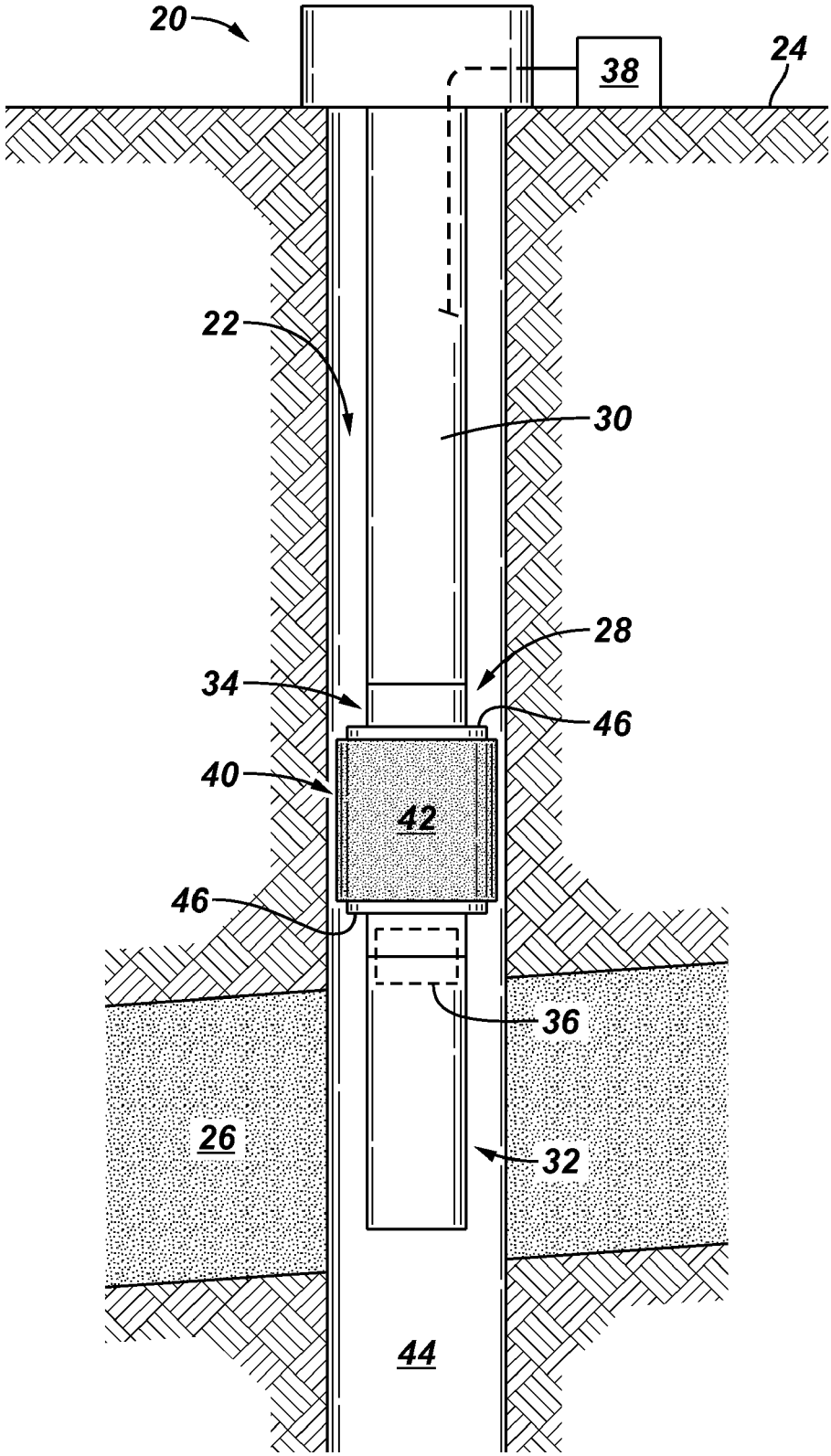
FIG. 1 is a front elevation view of a completion assembly deployed downhole in a wellbore proximate a subterranean formation, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology to facilitate the recovery of hydrocarbons in subterranean formations. According to one embodiment of the system and methodology, a well completion is designed to simplify placement of completion assemblies in a desired downhole location while permitting signal communication across the completion assemblies. By way of example, the communication of signals may comprise the communication of electrical signals, e.g. data or power signals, and/or the communication of hydraulic signals, e.g. hydraulic pressure for actuation of downhole devices.

In one embodiment, a well completion comprises a first completion assembly, e.g. a lower completion assembly, disposed along a sand face in a wellbore. A second completion assembly, e.g. an upper completion assembly, may be selectively engaged with the first completion assembly. During engagement, a signal communication system is coupled to enable communication of signals between the first completion assembly and the second completion assembly. The signal communication system may comprise, for example, an inductive coupler and a wet-mate connector. In some applications, the system also comprises a hydraulic isolation device, e.g. a packer, to provide a desired hydraulic isolation, such as hydraulic isolation of the first completion assembly during landing of the second completion assembly.

According to embodiments described in greater detail below, a method and system are provided for monitoring and control of completion assemblies that have been deployed in a reservoir in a series of stages, and for which hydraulic isolation may be desired when landing one stage into an earlier stage. The monitoring may be accomplished through sensors, such as a sensor array, that is placed along a sand face. By way of example, the sensor array may be a spoolable array of sensors, e.g. temperature sensors, and the sensors may be deployed by various techniques including deployment with a stinger assembly or along a sand-control apparatus, e.g. a gravel-pack screen.

Communication from the sensors to the surface may be accomplished through an inductive coupling in which an alternating electromagnetic field is used to provide a wireless step from one completion stage/assembly to the next. The inductive coupler also may be used to provide power to one or more downhole devices. The inductive coupling component will typically include a solenoidal coil in one stage of a completion which is placed in proximity to a solenoidal coil in the next stage of the completion. Those coils may be of approximately similar axial extent as described, for example, in SLB Patent Application US20090066535 or one coil may be of an axial extent significantly different to the other coil. The inductive coupler may also be combined with a movable joint in the upper completion such as described in US20090066535 by Schlumberger. The movable joint would allow a mechanical decoupling between the landing of the bottom and the top of the completion stage. In other applications, power may be provided through alternate sources, such as downhole batteries, or through other techniques including providing hydraulic power via appropriate hydraulic signals directed through hydraulic control lines. In the case that a movable joint is used, then that joint can also be constructed to convey electrical and/or hydraulic control lines.

The system and methodology also may utilize flow control devices as part of the downhole well completion. For example, flow control may be exercised with one or more inflow control devices that may be activated via hydraulic lines extending to a surface location. In one embodiment, the functionality of inflow control devices is improved through the use of annulus sealing devices, including swellable packers or other swellable devices deployed externally of desired inflow control devices. In this particular example, swellable or otherwise expandable materials may serve as a barrier or partial barrier to fluid movement along the annulus external to the inflow control device. As described in greater detail below, hydraulic and/or electrical control lines may be routed through the swellable material which may be configured to naturally deform around the control lines.

Hydraulic isolation from one completion stage to the next within the well completion may be accomplished through the use of appropriate sealing devices, such as a polished bore receptacle and mating seal assembly. By way of example, the seal assembly may be mounted at the generally leading end of a second or upper completion assembly, and the polished bore receptacle may be positioned at the corresponding engagement end of the first or lower completion assembly proximate a lower completion packer. During engagement of the completion assemblies, the seal assembly may be lowered into a honed surface of the polished bore receptacle.

Referring generally to FIG. 1, an example of a well system 20 is illustrated according to an embodiment of the present invention. In this example, well system 20 is deployed in a wellbore 22 that extends from a surface location 24 to intersect with at least one formation 26. Formation 26 may contain hydrocarbons, e.g. oil and/or gas, which may be produced upwardly to the surface location 24. Alternatively, fluids, e.g. treating fluid or water, may be injected downwardly through wellbore 22 and into formation 26.

In the illustrative embodiment, well system 20 comprises a well completion 28 deployed downhole into wellbore 22 via a suitable conveyance 30. By way of example, well completion 28 may comprise a plurality of completion assemblies including a first completion assembly 32, e.g. a lower completion assembly, engaged by a second completion assembly 34, e.g. an upper completion assembly. Well completion 28 further comprises a signal communication system 36 by which signals, e.g. electric and/or hydraulic signals, can be transmitted in either or both directions between first completion assembly 32 and second completion assembly 34. The signals can be communicated from or to a control system 38 located at surface 24 or at another suitable location.

Additionally, well system 20 may comprise an isolation device 40, such as a hydraulic isolation device, designed to isolate desired sections of wellbore 22. Effectively, isolation device 40 acts as a seal and may comprise a variety of expandable devices, including packers, and other sealing devices. Depending on the specific application, one or more isolation devices 40 may be attached to well completion 28 and/or conveyance 30. In some applications, for example, the isolation device 40 may be attached to first completion assembly 32 to isolate formation 26 while second completion assembly 34 is moved into engagement with the first completion assembly. In other applications, the isolation device 40 may be attached to second completion assembly 34, or isolation devices 40 can be attached to both completion assemblies.

In the example illustrated, isolation device 40 may be constructed from a swellable material 42 designed to swell when the material contacts or absorbs a triggering fluid. If isolation device 40 is mounted along conveyance 30, the conveyance 30 may comprise any device, tubing, or tool from which the swellable material 42 is able to transition from an unexpanded state to an expanded, sealing state. By way of specific examples, conveyance 30 may comprise coiled tubing or a tool deployed on a slick line or wireline to support the swellable material 42. As illustrated, the isolation device 40 also is readily mountable along well completion 28 for expansion, e.g. swelling, to seal off an annulus 44 surrounding the well completion. Furthermore, flanges 46 may be mounted to the well completion 28 and/or conveyance 30 at the longitudinal ends of swellable material 42 to guide expansion of the swellable material in a radial direction. As the swellable material swells and engages the surrounding wellbore wall, a fluid isolation zone is created. Depending on the application, the isolation device 40 can be expanded to seal against a variety of surfaces, including casing surfaces and open wellbore surfaces.

Figure 2:
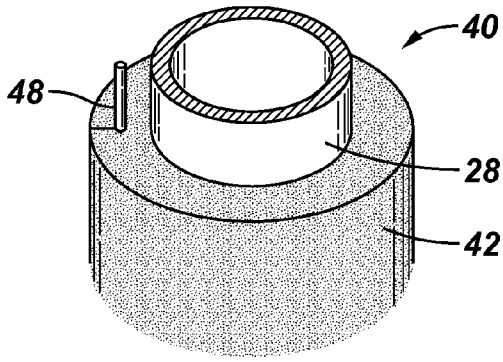
FIG. 2 is an enlarged, partial view of an annular seal member employed to isolate sections of the wellbore along the completion assembly in combination with a communication line routed through the seal member, according to an embodiment of the present invention.

As illustrated in FIG. 2, the use of swellable material 42 facilitates routing of one or more signal communication lines 48 across the isolation device 40. The signal communication lines 48 may comprise individual or multiple control lines routed past the isolation device 40 to various downhole components, as described in greater detail below. Signal communication lines 48 may comprise a variety of control lines for routing many types of signals. By way of example, control lines 48 may comprise electric lines able to transmit communication signals, e.g. data signals, power signals, and other types of signals. Signal communication lines 48 also may comprise hydraulic lines used to transmit hydraulic signals, such as pressure signals for actuating downhole tools. Additionally, control lines 48 may comprise other types of control lines, e.g. fiber optic lines, for carrying desired signals downhole and/or uphole.

Figure 3:
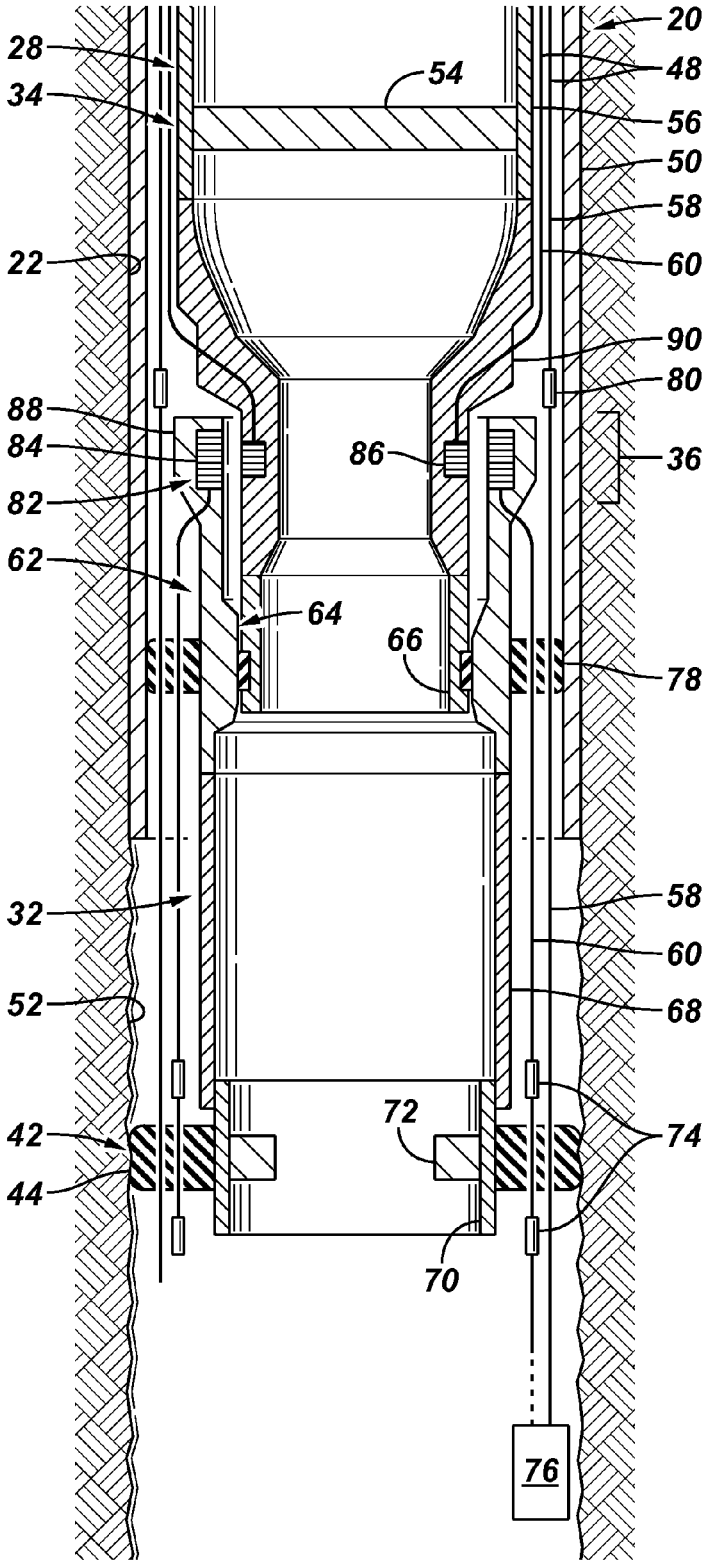
FIG. 3 is a cross-sectional illustration of engaged completion assemblies and a signal communication system, according to an embodiment of the present invention.

Referring generally to FIG. 3, one example of well completion 28 is illustrated in which second completion assembly 34 is selectively engaged with first completion assembly 32. Additionally, the embodiment comprises signal communication system 36 to facilitate the transfer of signals between the first completion assembly 32 and the second completion assembly 34 without requiring great precision/accuracy in the orientation of the second completion assembly 34 with respect to the first completion assembly 32, at least with respect to coupling certain control lines.

In the embodiment illustrated, a casing 50 is deployed along wellbore 22 and extends to an uncased sand face 52, although subsequent casing strings may be located below sand face 52. Well completion 28 is deployed in wellbore 22 proximate sand face 52 by initially deploying first completion assembly 32. Depending on the application, a variety of treatment procedures, including gravel packing, cementing, and other procedures can be conducted with respect to first completion assembly 32. Subsequently, the second completion assembly 34 is deployed downhole and moved into engagement with first completion assembly 32. The upper completion assembly 34 may be deployed with a safety valve 54 positioned within a tubular portion 56 of second completion assembly 34 so as to be controllable from the surface. Additionally, the upper completion assembly 34 may comprise or be deployed with signal communication lines 48, such as a hydraulic control line 58, e.g. a hydraulic umbilical, and an electric control line 60. A variety of other types of signal communication lines, e.g. control lines, can be deployed with or as part of completion assembly 34.

The first completion assembly 32 may be constructed in a variety of forms with many types of components. In the example illustrated, first completion assembly 32 comprises an engagement portion 62 for receiving second completion assembly 34. By way of example, engagement portion 62 may comprise a polished bore receptacle 64 designed to receive a corresponding seal assembly 66 of second completion assembly 34 when the completion assemblies are engaged. However, first completion assembly 32 may comprise a variety of additional components, such as a liner section 68 extending from engagement portion 62. In the specific example illustrated, liner section 68 is connected with a reduced diameter liner 70 that supports, for example, isolation device 42. As described above, isolation device 42 may comprise a packer, such as a packer formed with swellable material 44, to enable selective isolation of the wellbore. In this example, the isolation device 42 is designed to isolate regions of the wellbore proximate sand face 52.

First completion assembly 32 may comprise various other components, such as one or more flow control devices 72, e.g. inflow control devices, to control fluid flow through the well completion 28. In the example illustrated, the flow control device 72 is disposed generally proximate isolation device 42 along an interior of reduced diameter liner 70. The one or more flow control devices 72 may be connected to appropriate control lines, such as hydraulic control line 58 and/or electric control line 60. In some applications, the hydraulic control line 58 may be used to actuate the flow control device 72, while the electric control line 60 may be used to communicate data related to flow control device 72 to the control system 38 (see FIG. 1). As illustrated, segments of hydraulic control line 58 and electric control line 60 may be adjacent to or formed as part of the first completion assembly 32. These control line segments may be operatively engaged with the corresponding control line segments of second completion assembly 34 via signal communication system 36 when second completion assembly 34 is landed in first completion assembly 32.

As further illustrated in FIG. 3, the completion assembly 28 may comprise one or more downhole devices, including sensors 74 for sensing a variety of well related parameters, such as temperature or pressure, among others. By way of example, sensors 74 may be arranged in a sensor array deployed along sand face 52. If isolation device 42 is formed with swellable material 44, the swellable material 44 can facilitate passage of the electric control line 58 between sensors 74 on opposite sides of isolation device 42. In some applications, electric control lines 58, hydraulic control line 60, and/or other control lines may be routed to other types of downhole devices 76 to provide data communication, power, and/or actuation energy. It should be noted that well completion 28 can be constructed with or used in cooperation with other devices, such as packer 78. In the embodiment illustrated, packer 78 serves as an isolation device between the first completion assembly 32 and casing 50 to seal off the sand face area 52. By way of example, packer 78 may be a ported packer to enable pass through of control lines 48.

Signal communication system 36 may also be constructed in a variety of forms with many types of components. In the example illustrated, the signal communication system provides a wet-mate connector 80, such as a hydraulic line wet-mate connector, and an inductive coupler 82 to enable two-way transmission of electric signals, e.g. communication and/or power signals, between first completion assembly 32 and second completion assembly 34. The wet-mate connector 80 may be disposed above inductive coupler 82. In the embodiment illustrated, inductive coupler 82 comprises an inductive coupling component 84 located on first completion assembly 32 and a corresponding inductive coupling component 86 located on second completion assembly 34.

By way of example, inductive coupling component 84 may be mounted in a housing section 88 of first completion assembly 32 at a position provided above polished bore receptacle 64. Corresponding inductive coupling component 86 may be mounted in a housing section 90 of second completion assembly 34 at a position provided above seal assembly 66. The first segment of electric control line 60 may be connected to inductive coupling component 84, and the second segment of electric control line 60 may be connected to corresponding inductive coupling component 86. When second completion assembly 34 is moved into engagement with first completion assembly 32, the corresponding inductive coupling component 86 is moved into proximity with inductive coupling component 84 without requiring substantial positional accuracy. Substantially simultaneously, other control line segments, e.g. segments of hydraulic control line 58, can be joined via wet-mate connector 80.

Depending on the arrangement of components and the type of wet-mate connector utilized, mechanical positioning may be required in some applications. Because of stack-up tolerancing issues, the present system benefits from the properties of the inductive coupler 82 and polished bore receptacle 64/seal assembly 66 by providing a certain amount of tolerance. As a result, the inductive coupler 82 and polished bore receptacle 64 simplify the set-up for engaging completion assemblies downhole.

In some applications, the housing 88, which serves as a communication coupling structure, may be attached to an additional length of liner 68 to allow the relative positioning of the inductive coupler 82 and other various downhole components, e.g. safety valves, as desired. In one embodiment, the communication component or housing 90 may comprise additional sensors 74 for providing measurements, such as pressure and temperature, among others. One example of a sensor system that can be incorporated into the completion assembly in this manner is the WellNet Station available from Schlumberger Corporation. Such a station also can act as a downhole telemetry hub to combine the well parameter data collected from the sand face region 52 with other sensor data collected along second completion assembly 34. This type of station also may serve as the modem to pass data and power through the inductive coupler 82. The up going and down going communication may be performed using various telemetry protocols, including ampliture modulation for up going communication and frequency modulation for down going communication.

As illustrated, some embodiments of well system 20 may utilize reduced diameter liner 70 along sand face region 52. The reduced diameter liner 70 may facilitate the placement of multiple isolation devices 42, e.g. multiple swellable devices, along the exterior of liner 70. Corresponding inflow control devices 72 can be placed along the interior of liner 70 and activated via, for example, hydraulic control line 58. In some applications, various flow control related data is communicated up through signal communication system 36 via electric control line 60.

Similarly, data from sensors 74, e.g. a sensor array, may be delivered up through signal communication system 36 via inductive coupler 82. It should be noted that a variety of sensors 74 can be used to obtain well related data from along sand face 52; however one embodiment utilizes platinum resistive devices to provide temperature measurements. By obtaining temperature measurements from an array of sensors 74 along sand face 52, inferences can be made regarding the flow of fluid from the surrounding reservoir. Regardless of the sensor type, signal communication system 36 enables the flow of a variety of signals, e.g. electric power signals, electric data signals, hydraulic signals, and/or other signals via inductive coupler 82 and/or wet-mate connector 80.

Figure 4:
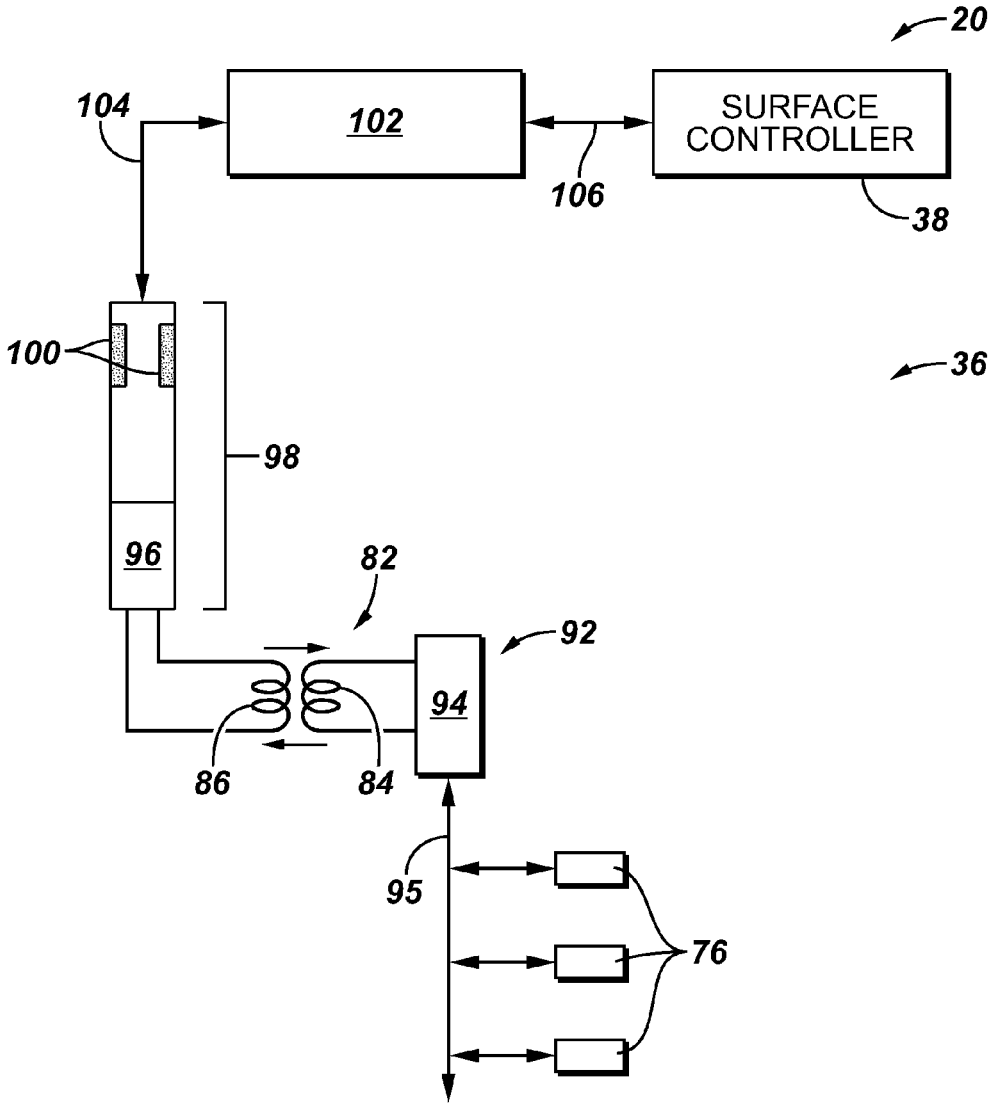
FIG. 4 is a schematic illustration of a signal communication system employing an inductive coupler to facilitate the transfer of electric signals without requiring precise alignment of the joined completion assemblies, according to an embodiment of the present invention.

Referring generally to FIG. 4, one embodiment of a communication system implementing inductive coupler 82 is illustrated. In this embodiment, inductive coupler 82 comprises an electrical cartridge 92 having a first inductive communication device 94 coupled to inductive component 84. The electrical cartridge 92 is connected to a plurality of downhole devices 76, which may comprise an array of sensors 74 and/or other downhole devices. The plurality of downhole devices 76 may be arranged along sand face 52 to provide a plurality of measurements, e.g. temperature measurements, pressure measurements, and/or flow measurements. Additionally, a telemetry bus 95 may be deployed along the sand face to carry signals, e.g. data or power, between downhole devices 76 and electrical cartridge 92.

Within second completion assembly 34, the corresponding inductive component 86 is positioned to enable two-way communication across the signal communication system. The corresponding inductive component 86 is coupled to a second inductive communication device 96 which may be part of a downhole communication hub 98, such as the Schlumberger WellNet Station referenced above. The downhole communication hub 98 may comprise a variety of gauges and other types of sensors 100 and may be configured to transfer signals to/from sensors 100 and/or downhole devices 76.

In the example illustrated, communication hub 98 is designed to communicate with an electronics module 102 via a communication line 104, such as a twisted pair communication line. If signal communication system 36 is deployed in a subsea well, electronics module 102 may be a seabed electronics module. In this latter example, electronics module 102 may communicate with surface controller 38 via an appropriate communication line 106, such as an umbilical.

The communication system 36 illustrated in FIG. 4 can be isolated from wellbore fluids and even from airborne contaminants. For example, oxygen and water are known to degrade downhole permanent components and thus limit their lifetime. However, inductive coupler 82 enables the communication system to be hermetically sealed even when deployed across a completion that is delivered downhole in a plurality of completion assemblies, as described above. The inductive coupling also protects the downhole components against the creation of galvanic currents that would otherwise cause corrosion at the contacting component interface.

The overall well system 20 and signal communication system 36 may be arranged in a variety of configurations. For example, various combinations of the inductive coupling, seal bore assembly, and wet-mating components (e.g. hydraulic wet-mating components) may be arranged. The inductive coupling may be rotationally invariant and tolerant to certain amounts of axial displacement, and the same is true of polished bores used in conjunction with sealing assemblies. Consequently, both components can be included in a completion string without hindering the mating of a third component that does require accurate landing or rotational alignment.

Combining such features provides a completion mating process that provides pressure sealing, electrical transmission of power, data communication, and a hydraulic conduit. The hydraulic conduit may further provide hydraulic power and activation of downhole devices, such as downhole control valves. The hydraulic conduit also can act as a fluid path through which a pump-able apparatus is deployed. For example, the pump-able apparatus may comprise an optical fiber that is pumped down through a control line so as to have a continuous optical path from the wellhead to a point lower in the completion, e.g. the sand face region 52 (see FIG. 1). Various optical fiber technologies can be used to measure downhole well parameters, such as temperature, strain, pressure, noise, seismic energy, water cut, and other parameters.

The signal communication system may be incorporated into a variety of completion systems to facilitate deployment of a completion in multiple stages. Depending on the well application, the size and configuration of both the well completion and its signal communication system may vary. For example, the size, number and arrangement of signal communication components may be selected according to the needs of an anticipated downhole application. Also, the inductive coupling can be used in cooperation with one or more of a variety of other mating communication lines. For example, wet-mate connectors can be used to join hydraulic lines, electrical lines, optical lines and other types of signal communication lines. Additionally, many types of signals can be transferred to a variety of devices downhole; and many types of signals can be transferred from downhole devices, e.g. sensors, uphole to, for example, a surface control system.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a well, comprising:

a well completion having:

a first completion assembly disposed along a sand face in a wellbore;

a second completion assembly selectively engaged with the first completion assembly;

a signal communication system to communicate signals between the first completion assembly and the second completion assembly, the signal communication system comprising an inductive coupler and a wet-mate connector; and a sensor array deployed along the sand face, wherein signals from the sensor array are communicated across the first and second completion assemblies via the signal communication system.

2. The system as recited in claim 1, wherein the first completion assembly and the second completion assembly are joined via a polished bore receptacle.

3. The system as recited in claim 1, wherein at least one of the first and second completion assemblies comprises a flow control device.

4. The system as recited in claim 1, wherein the well completion further comprises at least one expandable packer to seal of an annulus surrounding the well completion.

5. The system as recited in claim 4, wherein the expandable packer comprises a swellable material.

6. The system as recited in claim 1, wherein the sensor array is constructed as a spoolable array.

7. The system as recited in claim 1, wherein the wet-mate connector comprises a hydraulic line wet-mate connector.

8. The system as recited in claim 1, wherein the inductive coupler enables communication of electric signals between a first electric control line and a second electric control line.

9. The system as recited in claim 1, wherein the well completion comprises at least one device that receives power through the inductive coupler.

10. A method, comprising:

positioning a first completion assembly downhole along a sand face;

moving a second completion assembly into engagement with the first completion assembly;

establishing an inductive coupling and a wet-mate coupling when the second completion assembly is moved into engagement with the first completion assembly;

transmitting signals via both the inductive coupling and the wet-mate coupling; and deploying a sensor array along the sand face.

11. The method as recited in claim 10, wherein transmitting comprises transmitting signals related to measurements of wellbore properties.

12. The method as recited in claim 11, wherein transmitting comprises transmitting signals related to controlling flow devices.

13. The method as recited in claim 10, wherein moving comprises engaging the first and second completion assemblies through a polished bore receptacle.

14. The method as recited in claim 10, further comprising selectively sealing an annulus around at least one of the first and second completion assemblies with a swellable packer.

15. The method as recited in claim 10, further comprising providing power through the inductive coupling.

16. A system for use in a well, comprising:

a signal communication system, comprising:

a first inductive coupling component mounted to a first completion assembly;

a second inductive coupling component mounted to a second completion assembly;

a downhole component electrically coupled to the first inductive coupling component;

a hydraulic isolation device to provide hydraulic isolation for the first completion assembly during landing of the second completion assembly, wherein signals related to the downhole component can be passed between the first inductive coupling component and the second inductive coupling component regardless of the precise orientation of the second completion assembly with respect to the first completion assembly when engaged; and a wet-mate connector to couple a hydraulic line extending between the first completion assembly and the second completion assembly.

17. The system as recited in claim 16, wherein the downhole component comprises a flow control device.

18. The system as recited in claim 17, wherein the flow control device is actuated by a hydraulic signal communicated through the hydraulic line.

19. A method, comprising:

providing a first completion assembly with an inductive coupling component;

providing a second completion assembly with a corresponding inductive coupling component to enable two-way communication across the inductive coupling component and the corresponding inductive coupling component when the second completion assembly is engaged with the first completion assembly;

electrically connecting a downhole component with the inductive coupling component, wherein electrically connecting comprises connecting a sensor array; and establishing hydraulic communication through communication lines that are connected when the second completion assembly is engaged with the first completion assembly.

20. The method as recited in claim 19, wherein establishing comprises forming a wet-mate connection when the second completion assembly is engaged with the first completion assembly.

21. A system for use in a well, comprising:

a signal communication system, comprising:

a first inductive coupling component mounted to a first completion assembly;

a second inductive coupling component mounted to a second completion assembly;

a downhole component electrically coupled to the first inductive coupling component, and wherein the downhole component comprises a sensor array deployed along a sand face of the well; and a hydraulic isolation device to provide hydraulic isolation for the first completion assembly during landing of the second completion assembly, wherein signals related to the downhole component can be passed between the first inductive coupling component and the second inductive coupling component regardless of the precise orientation of the second completion assembly with respect to the first completion assembly when engaged.

* * * * *